US005546884A

United States Patent [19]

Van Den Haak

[11] Patent Number: 5,546,884

[45] Date of Patent: Aug. 20, 1996

[54] ANCHOR, ANCHORFLUKE AND METHODS FOR ANCHORING

[75] Inventor: Rob Van Den Haak, Krimpen A/D Ijssel, Netherlands

[73] Assignee: Vrijof Ankers Beheer B.V., Ijssel, Netherlands

[21] Appl. No.: 473,713

[22] Filed: Jun. 7, 1995

Related U.S. Application Data

[62] Division of Ser. No. 196,263, May 10, 1994.

[30] Foreign Application Priority Data

Aug. 16, 1991 [NL] Netherlands ..... 9101396
Feb. 14, 1992 [NL] Netherlands ..... 9200270

[51] Int. Cl.[6] ..... B63B 21/32

[52] U.S. Cl. ..... 114/301; 114/304

[58] Field of Search ..... 114/297, 298, 114/299, 303, 304, 310

[56] References Cited

U.S. PATENT DOCUMENTS 4,781,142 1/1988 Cheung ..... 114/304

OTHER PUBLICATIONS

"New Anchor designs" Oil and Gas Journal vol. 88, NO. 29, 16 Jul. 1990, TWISA pp. 66.

*Primary Examiner*—Jesus D. Sotelo
*Attorney, Agent, or Firm*—Ladas & Parry

[57] ABSTRACT

Anchor fluke, being formed as to have a penetration or front-side and a rear side, as well as a longitudinal plane of symmetry intersecting these sides, the anchor fluke comprising first device for attachment of an anchor line for use in a vertical anchoring system and a second device for attachment of at least two connecting lines spaced in the longitudianl plane of symmetry so as to connect the fluke to a pulling or penetration anchor line, the fluke being so formed that at least its upper surface has a shape convexly curved or buckled in cross-section along the plane of symmetry, the first attachment device for the anchor line for a vertical anchoring system being located near the center of area of the fluke.

22 Claims, 9 Drawing Sheets

304
302
306
303
305
308
307
315
314
316
301

J
319
318

L
K
315
301
316

L
302
306
K
315
Z
O
308
307
316

ANCHOR, ANCHORFLUKE AND METHODS FOR ANCHORING

This is a divisional of application Ser. No. 08/196,263 filed on May 10, 1994 which is pending.

The invention relates to an anchor, comprising a fluke means with a surface centre of gravity and a front end or penetration end and a rear end, and a shank means, being connected at a first end to the fluke means and at a second end being provided with first means for attachment to an anchor line, said shank means being fastened by means of at least one hinged joint to the fluke means. The invention is furthermore directed to a method for anchoring objects with the aid of such an anchor.

An anchor of the type as described above is known from U.S. Pat. No. 3,450,088. The anchor disclosed by this document comprises a straight shank, being fastened at its first end by means of a first hinged joint to the fluke, as well as a coupling rod extending between a point halfway down the shank and a point disposed between the first hinged joint and the front end of the fluke. At its one end the coupling rod is hinged on the fluke and at its other end it comprises a pin, fitting in a recess in the shank that opens obliquely downwards, the coupling rod being secured to the shank there also by means of a breaking bolt. When the anchor that has penetrated the soil has to be weighed again, one pulls an anchor line attached to the second end of the shank in an essentially vertical direction. The soil disposed above the fluke will prevent the fluke from turning with a force that is great enough to cause the breaking bolt to break. Subsequently the pin at the upper end of the coupling rod will also be twisted out of the recess, while the shank rotates upwards along with the anchor line when this is pulled, the shank pivoting about the first hinged joint with respect to the fluke. The anchor can then be weighed by pulling the anchor line, whereby the shank, the fluke and the coupling rod are eventually hinged with respect to one another in such a fashion that they are essentially aligned.

In recent years, drilling platforms have been installed in increasingly deep waters, and as a result the length of the pertaining anchor lines has also increased. Drilling platforms are generally anchored by means of eight to twelve anchors of 10 to 15 metric tons each. If it is desireable to remove the anchors with which the drilling platform is moored with a view to relocating the drilling platform, it is often quite difficult and costly to remove the anchors with the aid of auxiliary vessels. One should be aware that the wave conditions may be rough to the extent that such operations cannot be performed at all. Therefore it has been attempted for a long time to develop an anchor whose holding power can be reduced at will, so that it can be weighed so much more easily.

An example of such an anchor is discussed in the foregoing. The drawback of this known anchor is that for weighing this anchor, a separate vessel is required still, for if one would pull the anchor line from the drilling platform with a view to weigh the anchor, then it is to be expected that the fluke, extending at an angle with respect to the shank which is suited for sand or mud, will twist around the front end of the fluke, whereby the fluke surface projected perpendicularly to the direction of pulling is increased and thus the pulling force required to pull the fluke further through the soil will have to be considerably greater than the original holding power supplied by the anchor. The construction of the known anchor is such that when the breaking bolt breaks it is not to be expected that the pin will leave the recess if the second end of the shank is not pulled essentially in the vertical direction.

The invention aims to provide an anchor of the type referred to in the introduction, which can easily be weighed from its penetrated condition from aboard a moored object, such as a drilling platform. For that purpose the anchor of the invention is characterized in that the said hinged joint with which the shank means is attached to the fluke means is disposed at a location either towards the front or towards the rear at a distance from the centre of gravity, and in that the shank means is furthermore attached by means of a disconnectable connection to the fluke means at a location on a side of the centre of gravity facing away from the hinged joint, in which operating means are provided for effectuating the disconnection of the disconnectable connection by remote control.

When with the anchor according to the invention the disconnectable connection is released by activating the operating means, and a pulling force is exerted at the first end of the shank means, which force is smaller than the holding power initially provided by the anchor, a fluke means tilting moment will immediately be created at the first end of the shank means by the segment of soil against which the fluke means presses and by the pulling force transferred via the shank onto the fluke means. In this way the holding power of the anchor is quickly reduced and with a considerably lower force the anchor can be pulled directly to the drilling platform that is located at quite some distance.

According to a preferred embodiment of the anchor according to the invention, the hinged joint is located between the centre of gravity and the front end of the fluke means. As a result the angle of the fluke, i.e. the angle between shank means and fluke means, will immediately be reduced upon disconnecting, possibly temporarily, the disconnectable connection when pulling the anchor line, which, as will be discussed hereinafter, has many advantages, i.a. because the surface of the fluke means projected in the direction of pulling is immediately reduced.

It is remarked that Dutch patent application 86 00126 discloses an anchor that comprises a straight shank, being hinged on the fluke means which comprises at its rear end two trimming plates disposed on either side, i.e. one underneath and one on top. These trimming plates comprise abutments, against which a stop means disposed at the end of the shank can abut so as to determine the angle between shank and fluke means in one direction. The stop means comprises a pin that can be forced outwards by means of hydraulic pressure until it bears against one of the abutments, by gradually reducing the hydraulic pressure, a spring ensures that the pin is partially or entirely retracted in order to let the pin bear against the other abutments or to dispose it beyond the abutments alltogether, in order to increase the angle between shank and fluke means. The chosen construction entails that a maximally attainable angle between shank and fluke means is approx. 90°. The anchor is supposed to be weighed from aboard the drilling platform in a dragging fashion in this condition.

It is furthermore remarked that U.S. Pat. No. 4,781,142 (Cheung) discloses an anchor, whose shank is hinged on the fluke in its centre of gravity by means of a pin. The fluke comprises a plurality of sets of holes, which can be aligned to a hole in the lower end of the shank at choice, after which the shank and the fluke can also be connected to one another there by means of a stopper. On account of this feature the angle between shank and fluke can be adjusted, but it is not possible to do so by remote control.

According to the invention the operating means and the disconnectable connection may have been constructed in many different ways. For the disconnectable connection one could think of a pin-hole joint, the pin being mounted on the fluke and the hole being provided in the shank means. Another possible embodiment of the disconnectable connection is formed by a lever pawl, maintained in the operational position by a spring and being part of the fluke means, which pawl can be brought into engagement with a complementary shaped recess on the shank means by operating a hydraulic cylinder. Another option is a wedge joint. The operating means can be so devised as to respond to acoustic signals, transmitted to the anchor from a distance. Such an operating mechanism is extensively discussed in Dutch patent specification 86 00126 referred to above, of which the contents should be considered inserted here. Apart from using an acoustic signal to activate the operating means, one could also employ a pulling wire or an electric operating wire which extends between the anchor and the water level.

The operating means are disposed essentially at the underside of the fluke means so as to hamper the flow of soil over the fluke means to the least possible extent. It may be necessary, however, to dispose certain parts of the operating means on top of the fluke means after all, e.g. a receiver for acoustic signals for acoustically activated operating means.

It may be desireable to devise the disconnectable connection so that it can be disconnected yet also be reconnected in one or more mutual positions of the shank means and the fluke means and subsequently, if required, be disconnected again. For example, the situation may occur that once an anchor is cast it is found afterwards that the nature or consistency of the soil is not what was excepted. In soft soils a fluke angle between shank and fluke of approx. 50° is optimal, and in tough soils a fluke angle of approx. 32°. By activating the operating means, e.g. by means of acoustic signals or by means of a pulling wire, the disconnectable connection of an adjustable anchor according to the invention can be released, and when a desired fluke angle is attained, it can be re-established. When the pin or lever etc. is tensioned under spring load to a coupling position, the operating means merely have to be activated briefly and the coupling will automatically be restored when such is desired.

Another situation in which it may be desireable to manipulate the fluke angle from a distance is when a drilling platform is positioned in the vicinity of a pipe line and it is desireable to place the anchor closer to the drilling platform. This can be done by first pulling the anchor at the fluke angle suited for that particular kind of soil as deeply into the soil as possible and by subsequently activating the operating means so as to release the disconnectable connection, then pulling the anchor line in a more vertical direction, and finally, when the shank extends essentially in the direction between fluke and drilling platform, to re-establish the disconnectable connection. According to the in vention an anchor is provided with which the fluke angle can even be fixed at 90°. If one wants to weigh the anchor, the disconnectable connection is released again with the aid of the operating means and passed along possible coupling positions with possible interim disconnecting operations until the fluke is connected to the shank only by means of the hinged joint and the fluke can turn away to an almost vertical position when the anchor line is hauled in.

It is also remarked that on account of the greater water depths and therefore greather lengths of anchor line, a method of simple, vertical anchoring is sought instead of the use of quite expensive piles, for which due to the greater water depth increasingly advanced piling equipment has to be developed. One option is to shoot anchors into the ground, after which the anchors position themselves horizontally if a vertical force is exerted on them. The explosions required for this are undesirable from an environmental point of view. The anchor of the invention can be pulled into the ground in the usual way, after which one has to take care that the vertically exerted force is essentially in the centre of gravity of the fluke surface.

In order to ensure in such vertical anchoring the position of a fluke which is obliquely disposed in the soil and in order to prevent the fluke from swinging back, the invention has the feature that the fluke means at its rear end merges into an auxiliary fluke means, arranged to extend obliquely downwards and rearwards from the fluke means. Preferably the auxiliary fluke means is freely hinged on the fluke means and the fluke means comprises an abutment for restricting the extent of downward deflection of the auxiliary fluke means.

According to a preferred embodiment, the disconnectable connection comprises at least one hole at the first end of the shank means and a pin on the fluke means fitting into said hole, the operating means being designed for moving the pin into and out of the hole and keeping it in the desired position. Alternatively, the disconnectable connection may comprise a rack pertaining to the shank means as well as a pawl means mounted on the fluke for cooperation with the rack on the fluke, and for being brought into and out of engagement with the rack by the operating means.

The shank means of the anchor can be formed in the fashion shown by Applicant's European patent 49455. This shank means comprises two plate-shaped shank members, being placed so that they converge towards one another and towards the second end of the shank means and also forwardly. In that case it is not only important that the axis of the hinged joints of the shank members and the fluke are aligned, and are preferably perpendicular to the plane of symmetry of the anchor, but also that the cooperating parts of the disconnectable connection that can be adjusted to a plurality of positions and are provided on the fluke and the shank legs are able to move alongside each other upon releasing or re-adjusting the connection. The rack or the plate comprising holes which is twisted along with the shank leg in question should therefore be disposed in a plane perpendicular to the hinge axis of the hinged joint of the shank means and the fluke.

The invention furthermore relates to an anchor fluke and to an anchor fitted with such a fluke, being particularly suited for anchor systems in which the anchoring forces exerted on the object to be anchored are essentially directed vertically.

In recent years, drilling platforms have been installed in increasingly deep waters, and as a result the length of the pertaining anchor lines also increases. Drilling platforms are generally anchored by means of eight to twelve anchors of 10 to 15 metric tons each. In order to restrict the length of the anchor lines to the highest possible extent, the system of vertical anchoring was conceived. Vertical anchoring is usually applied in TLPs with the aid of tie rods and extremely expensive piles, for which increasingly advanced piling equipment needs to be developed on account of the great water depth. Another possibility is to shoot the anchors into the ground, after which they assume horizontal positions if a vertical force is exerted on them. The explosions required herefor are undesireable from an environmental point of view.

The object of the invention is furthermore to provide an anchor fluke and an anchor fitted with such an anchor fluke that can be easily pulled into the ground, and, once they have penetrated the soil up to the desired depth, are able to perform their vertical-anchoring function without any further action being required.

For this purpose the invention provides a fluke that is so formed as to have a longitudinal plane of symmetry, comprising means for attachment of a vertical-anchoring line and means for attachment of at least two connecting lines spaced in the longitudinal plane of symmetry so as to connect the fluke to a penetration anchor line, the fluke being so formed that at least its upper surface has a shape convexly curved or buckled in cross-section along that plane, the attachment means for the vertical-anchoring line being located near the centre of gravity of the fluke.

An anchor fitted with such a fluke will be easy to pull into the anchoring soil, e.g. mud or sand, in the usual fashion by pulling the penetration anchor line. The larger part of the curved or buckled upper surface of the fluke which is located behind the centre of gravity viewed in the direction of pull will have little or no influence then. This part of the fluke surface, however, will be quite important once the vertical-anchoring line is pulled. Then the effective fluke surface will have been considerably enlarged.

Preferably the lower surface of the fluke is almost equal in shape to the upper surface of the fluke. On account of this feature, during penetration of the fluke into the soil a moment is generated on the part of the lower surface of the fluke located behind the centre of gravity of the fluke in cooperation with the soil pressing against it, which moment ensures that the fluke will assume a steeper angle in the initial stage of penetration, thus enhancing penetration.

According to a further preferred embodiment of the fluke of the invention, the upper surface and possibly the lower surface of the fluke also have a correspondingly curved or buckled appearance in a cross-section in a plane comprising the centre of gravity and being perpendicular to the said plane of symmetry of the fluke. The fluke is then shaped like a hollow shell or a double cone and this will make its course more stable during penetration. Preferably the upper surface and possibly the lower surface are at least essentially conical.

It is remarked that Dutch patent application 76 08728 discloses an anchor that is particularly suited for anchoring in muddy soils. Its shank structure is formed by a number of rods, while the fluke, viewed in vertical longitudinal section, has a curved shape. This type of anchor is unsuited for vertical-anchoring systems.

It is remarked that U.S. Pat. No. 3,470,840 discloses an anchor fluke that has a curved shaped both in vertical longitudinal section and in vertical cross-section, but comprises only one attachment for an anchor line means disposed in the centre of gravity of the fluke, by means of which the fluke is induced to penetrate and the anchoring forces are transferred to the object to be anchored. This anchor too, is unsuited for vertical-anchoring systems.

Furthermore it is remarked that U.S. Pat. No. 2,721,530 discloses an anchor with a flat, triangular fluke, the plate-shaped fluke comprising in its vertices attachment means for connecting lines to an anchor line and being provided with a stabilizing fin at its lower surface. The course of this anchor is also instable and therefore it is unsuited for vertical-anchoring systems.

Finally it is remarked that Dutch patent specification 84 00890 discloses an anchor consisting of an essentially triangular, flat fluke, being provided at its vertices with holes for connecting lines to an anchor line. The course of this anchor too, is instable and therefore it is unsuited for vertical-anchoring systems.

When the attachment means between the fluke and the penetration anchor line are formed as cables or chains then an anchor is obtained whose weight is essentially determined by that of the fluke. As a consequence, the new anchor will be able to penetrate deeper into the anchoring soil than known anchors that are fitted with a rigid shank and have the same fluke surface.

Preferably the attachment means for the connecting lines to the penetration anchor line are disposed on the fluke at two locations spaced in the longitudinal direction viewed in projection on the plane of symmetry, in which the attachment means on the rearmost of these two locations can be operated by means of remote control so as to release the connection in question. Thus the anchor in question can easily be pulled out of the soil when such is required, for when the penetration anchoring line is pulled, a pulling force is only exerted on the frontmost attachment line(s) at the front of the fluke, and the area of the fluke that is located behind that will be able to tilt on account of the forces exerted thereon by the soil to a position of minimal resistance. The attachment means for the vertical-anchoring line may also indirectly constitute the attachment means for a single, central, rearmost connecting line, said connecting line then being connected to the lower end of the vertical-anchoring line and the latter itself being attached to the fluke for releasing it by means of remote control. Thus after the connection in question has been released, the exertion of a pulling force on the vertical-anchoring line will result in the displacement of the point of engagement of the pulling force exerted on the fluke from the centre of gravity of the fluke to the front, to the location where the frontmost connecting lines are attached.

According to an alternative embodiment, the attachment means for the vertical-anchoring line on the fluke are operable by means of remote control in order to release them, and furthermore a coupling line is disposed between the lower end of the vertical-anchoring line and the upper end of the connecting lines with the lower end of the penetration anchor line. Again, after releasing the releasable connection a pulling force exerted on the vertical-anchoring line will, at least during a first, initial period, be displaced to the frontmost area of the fluke, so that it will tilt to a position in which the fluke can be pulled out of the soil vertically. After a given period of time the rearmost connecting line(s) will be pulled taut, after which the fluke will assume a position dependent on the length of the two connecting lines with respect to the direction of pulling.

In those cases where the releasable connection is disposed at the lower end of the vertical-anchoring line it is advantageous to join possible operating lines for the said releasable connection with this anchor line. Then there is no need for any impeding, extra vertical line. Dependent on the embodiment of the releasable connection, there may be a pulling cable when there is a purely mechanical coupling, or a hydraulic or pneumatic conduit when the releasable connection can be operated hydraulically or pneumatically. Alternatively, it is of course also possible to choose an acoustically operated connection, which does not require an operating conduit.

According to a further development of the anchor of the invention, the frontmost and rearmost connecting lines are connected to the penetration anchor line by means of coupling means, which enable the adjustment of the angle formed by the connecting lines and the fluke. Preferably these coupling means consist of a coupling plate, comprising an attachment means for the penetration anchor line and attachment means for the frontmost and rearmost connecting lines, said attachment means thereon for the frontmost connecting lines being located at a different distance with respect to the attachment means thereon for the penetration anchor lines than the attachment means thereon for the frontmost connecting lines.

The invention furthermore provides an anchor comprising a fluke and a shank, the fluke having a front side or penetration side and a rear side, as well as a longitudinal plane of symmetry intersecting those sides, the anchor furthermore comprising first attachment means for attaching the fluke to a vertical-anchoring line, wherein at its one end the shank can be attached with the aid of second attachment means to a penetration anchor line and is mounted on the fluke at its other end through third attachment means, the shank comprising at least two lines, preferably cable-shaped or chain-shaped wires, at least two of which extend, when viewed in a projection on the plane of symmetry, divergingly towards the fluke, the anchor furthermore comprising operating means for operating the third attachment means by remote control so as to release the wires, and as a result, the shank from the fluke.

In this way, the (costly) penetration anchor line and the shank can be reclaimed so as to be used again. They are employed strictly for the minimally required period of time. What remains is the fluke, which is connected by a vertical-anchoring line to the superposed object to be anchored.

Preferably the operating means are connected to the vertical-anchoring line so as to activate the operating means due to a pulling force which is exerted on the vertical-anchoring line. In this way, an already present (vertical-anchoring) line between the fluke and a location above the water level is used to release the shank from the fluke, and this step also economizes on lines.

The pulling force in the vertical-anchoring line can be employed in many ways for disconnecting the third attachment means. In one embodiment of the anchor according to the invention the third attachment means comprise pins, which are able to engage attachment eyes at the ends of the wires so as to attach the wires of the fluke and which can be disengaged from the eyes by means of operating means. In this case the pins may have been slidably arranged and be hinged at one end on an end or the lever asembly, being mounted rotatably in the fluke for rotation about a shaft perpendicularly to the direction in which the pins are shifted, and on the other end being connected through connecting means to the vertical-anchoring line. These connecting means may e.g. be constituted by a cable that passes through the top surface of the fluke and is e.g. attached to the link right above the closing link at the lower end of the vertical-anchoring (chain) line, by means of which closing link the anchoring line is attached to an eye plate on the fluke.

It is possible that the wires are attached to the underside of the fluke in a common location with their other ends. In this way, only one, third attachment means will have to operated in order to release two diverging wires. Preferably a plurality of third attachment means spaced in the longitudinal direction is provided at the underside of the fluke for adjustment of the fluke angle as desired. It is then possible, that is if the lengths of the wires, which are interconnected at one end of the shank, have been chosen well, to create a fluke angle of 50°, in case the wires are jointly attached with their other ends at the location of the frontmost third attachment means to the fluke, and to create a fluke angle of 32°, in case the wires are attached with their other ends to the rearmost third attachment means of the fluke.

In the presence of two or more attachment means disposed one after the other, it is of course also possible to attach each of the wires separately with their other ends at the location of a third attachment means to the fluke, the attainable fluke angle than ranging between the aforesaid fluke angles, i.e. a fluke angle of e.g. 41°.

The invention also provides an anchor comprising a fluke, in which a part of the fluke, bordering on the rear and being disposed to the rear of the (surface) centre of gravity, is hinged on the remaining part of the fluke, the hinge axis being perpendicular to the plane of symmetry, in such a fashion that the upper surface of the hingeable rear part is able to assume an angle of over 180° with respect to the upper surface of the adjoining remaining part of the fluke. In this way it is achieved that when the vertical-anchoring line is tensioned, after it has been established that the fluke has penetrated sufficiently deep to be able to supply the correct vertical holding power, the fluke will move somewhat upwards, and due to the soil pressure of the segment of soil above the hingeable rear part, this rear part will be forced downwards with respect to the rest of the fluke. As a consequence, the fluke, when viewed in the section of the plane of symmetry, will get a reversed V-like shape, the largest, frontmost part of the fluke being directed upwards and forwards, and the rearmost part of the fluke being directed upwards and rearwards. This highly increases the stability of the position, horizontally, viewed in the plane of symmetry, while simultaneously the superposed segment of soil, pressing on the entire fluke, is increased, thus also increasing the holding power in the vertical direction. Preferably there are means on the fluke for restricting the extent of downward deflection of the hingeable rear part. These means may exist of a simply formed, possibly adjustable abutment mounted on the remaining portion of the fluke.

After the anchor as described in the foregoing has fulfilled its function in a vertical-anchoring system, the anchor, and in particular the fluke, will have to be weighed so that it may be used again. The invention provides means by which such an operation is greatly facilitated. According to the invention, the rear end of the hingeable rear part of the fluke is connected by means of a first weighing line to a ring slidable along the vertical-anchoring line. This ring comprises first coupling means that can be made to engage, in a coupling fashion, second coupling means on a ring-shaped catcher which is also slidable along the vertical anchoring line. The ring-shaped catcher is then lowered on a second weighing line along the vertical-anchoring line starting at water level, until the catcher is coupled to the ring that is connected to the rear end of the fluke. After the catcher and the ring have been coupled in an automatic fashion, the assembly of ring and catcher can be hoisted upwards along the vertical-anchoring line by pulling the second weighing line. In doing so, an upward force is exerted on the rear part of the fluke. If this force is great enough, the rear part will be able to hinge upwards with respect to the remaining part of the fluke and point obliquely upwards with respect to the remaining part of the fluke. If the second weighing line is made strong enough, continued pulling of the weighing line will result in the fluke being pulled upwards by an upward force exerted thereon at the rear part. During the upward movement, the remaining part of the fluke will then automatically swivel to the position of the least resistance.

The invention will now be further described on the basis of a number of embodiments, given merely as examples, which are shown in the drawing, in which.

Figure 12:
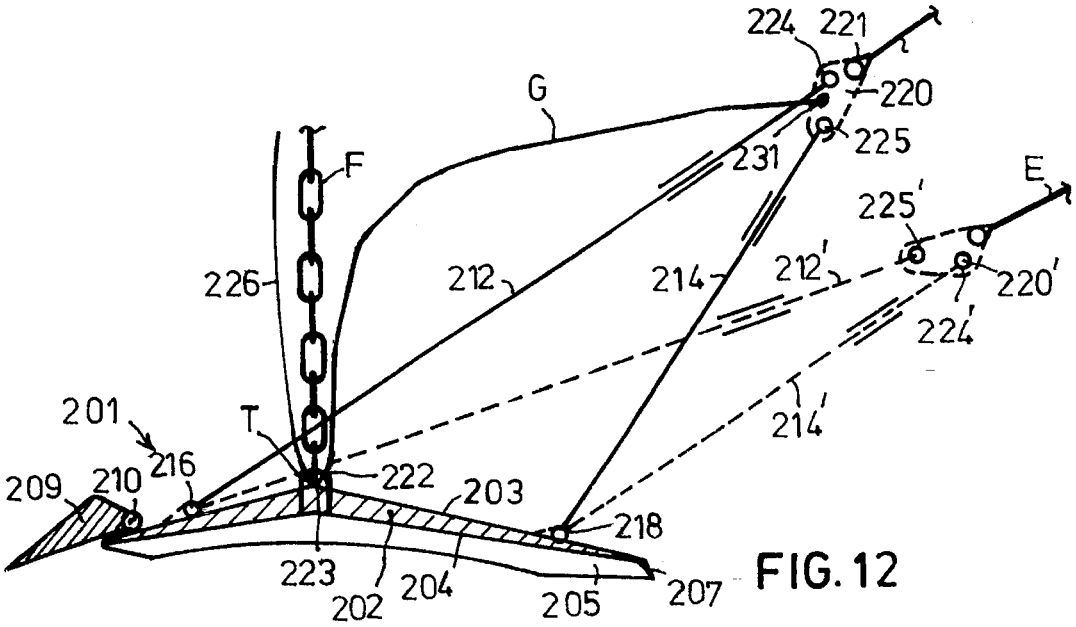
FIG. 12 is a vertical section along XII—XII in FIG. 13 of a preferred embodiment of the anchor according to the invention.
Figure 13:
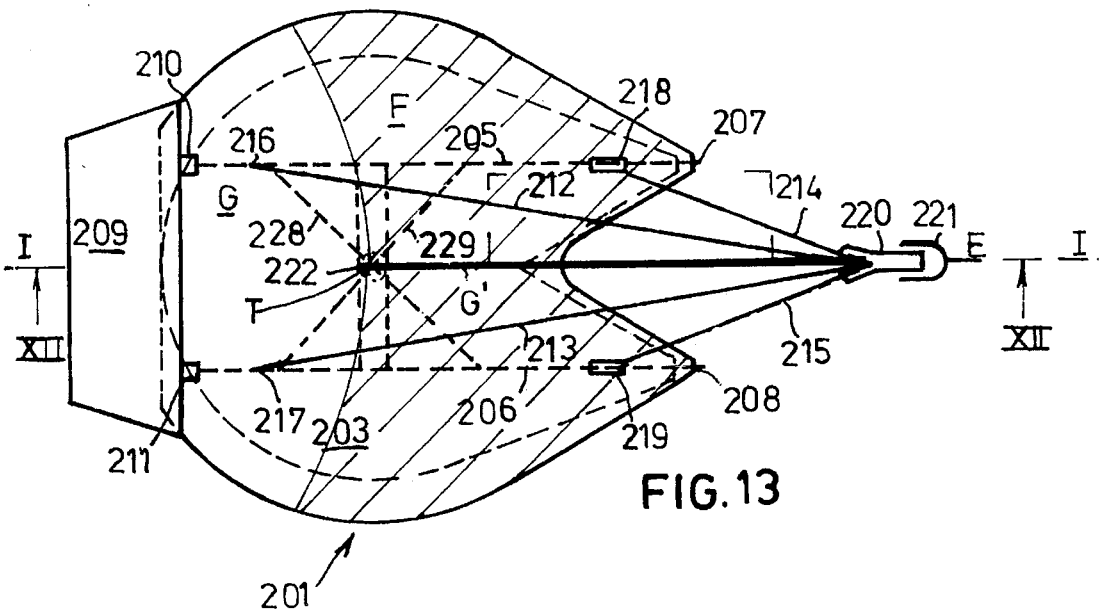
FIG. 13 is a top view on the anchor of FIG. 12.
Figure 14:
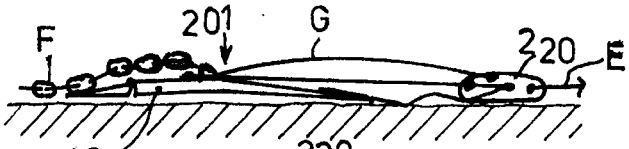
Figure 15:
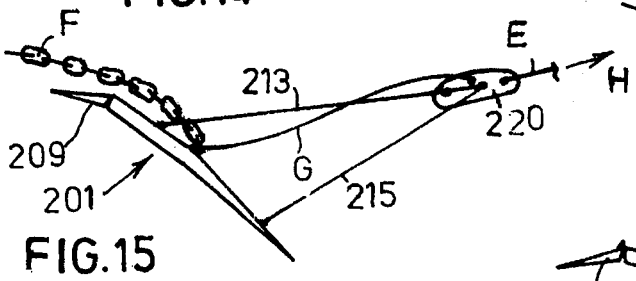
Figure 16:
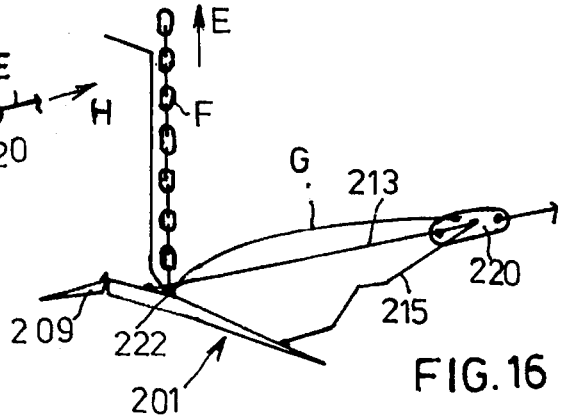
Figure 17:
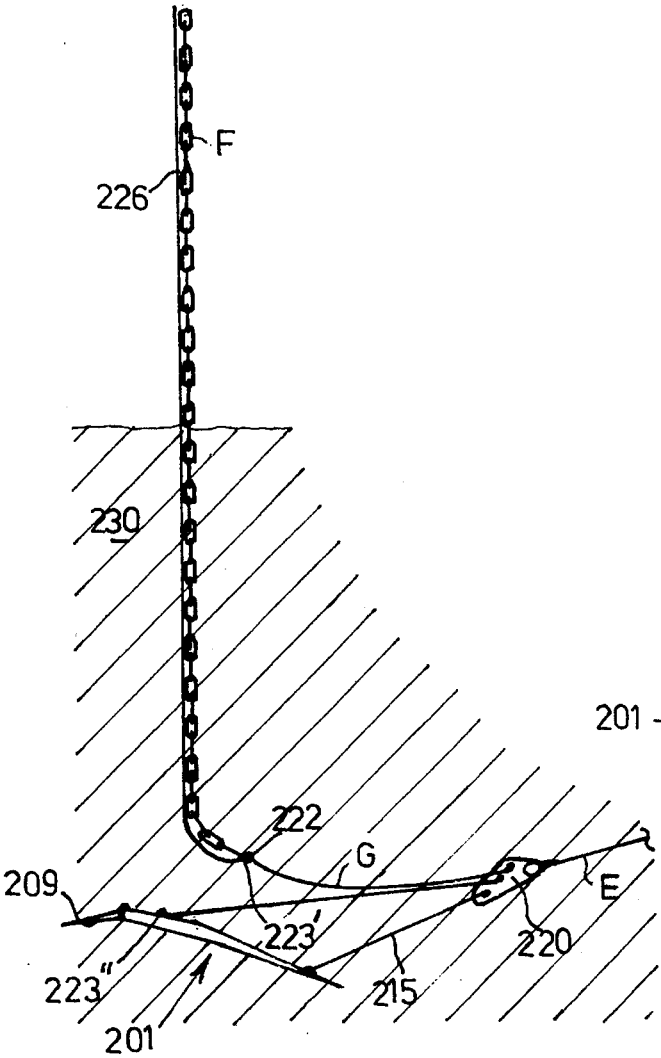
Figure 18:
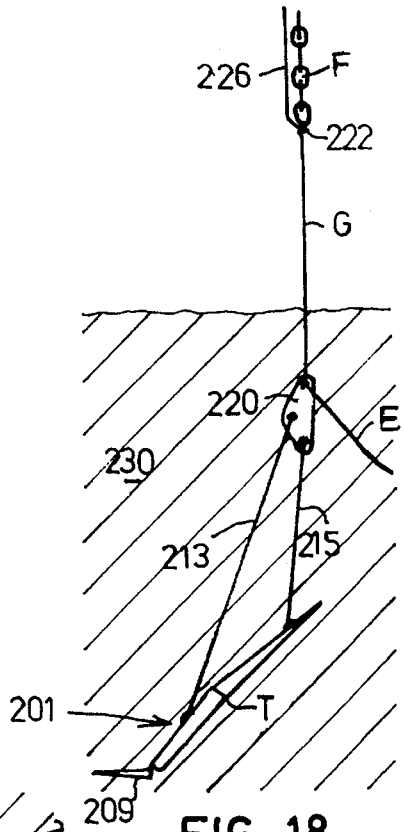
Figure 19:
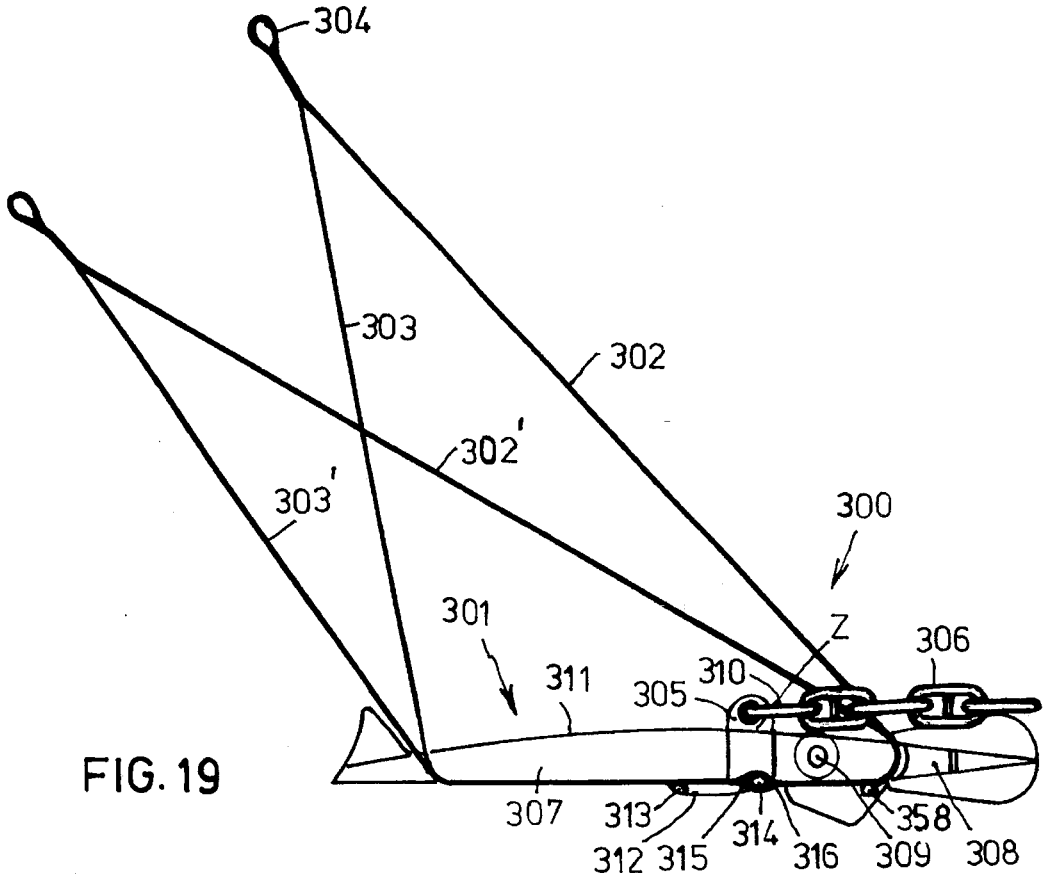
Figure 20:
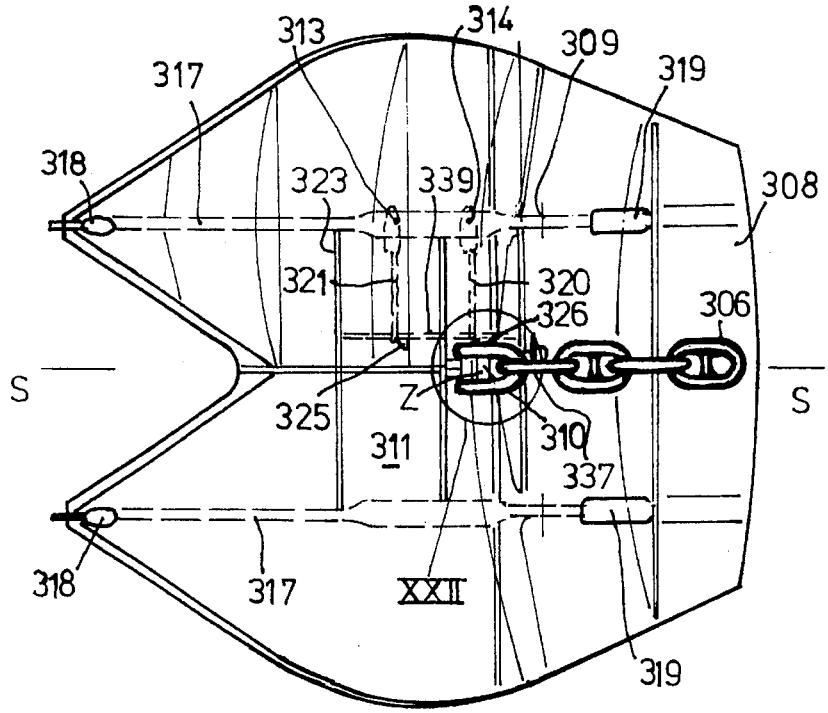
Figure 21A:
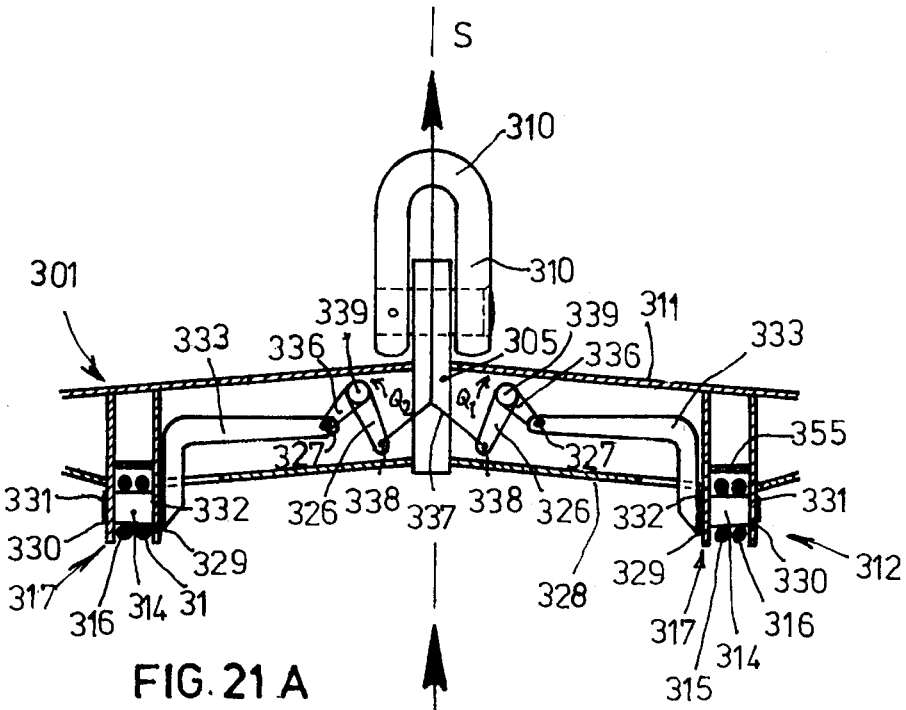
Figure 21B:
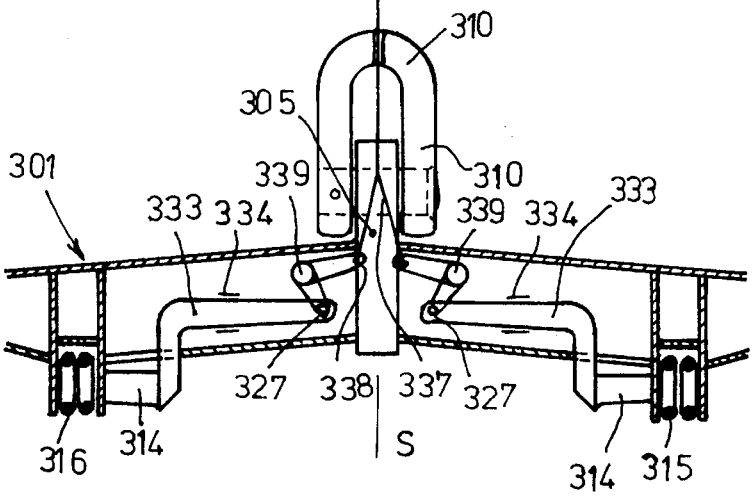
Figure 22:
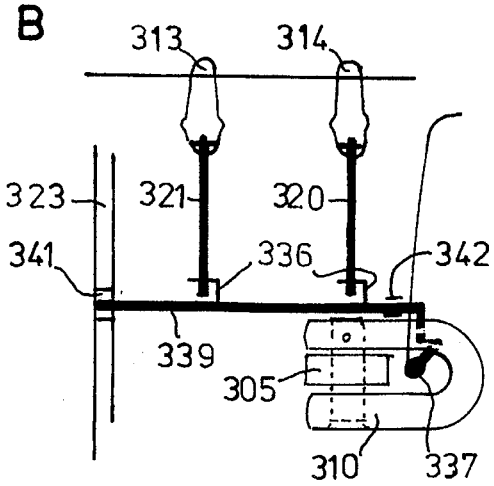
Figures 23A, 23B, 23C, 23D:
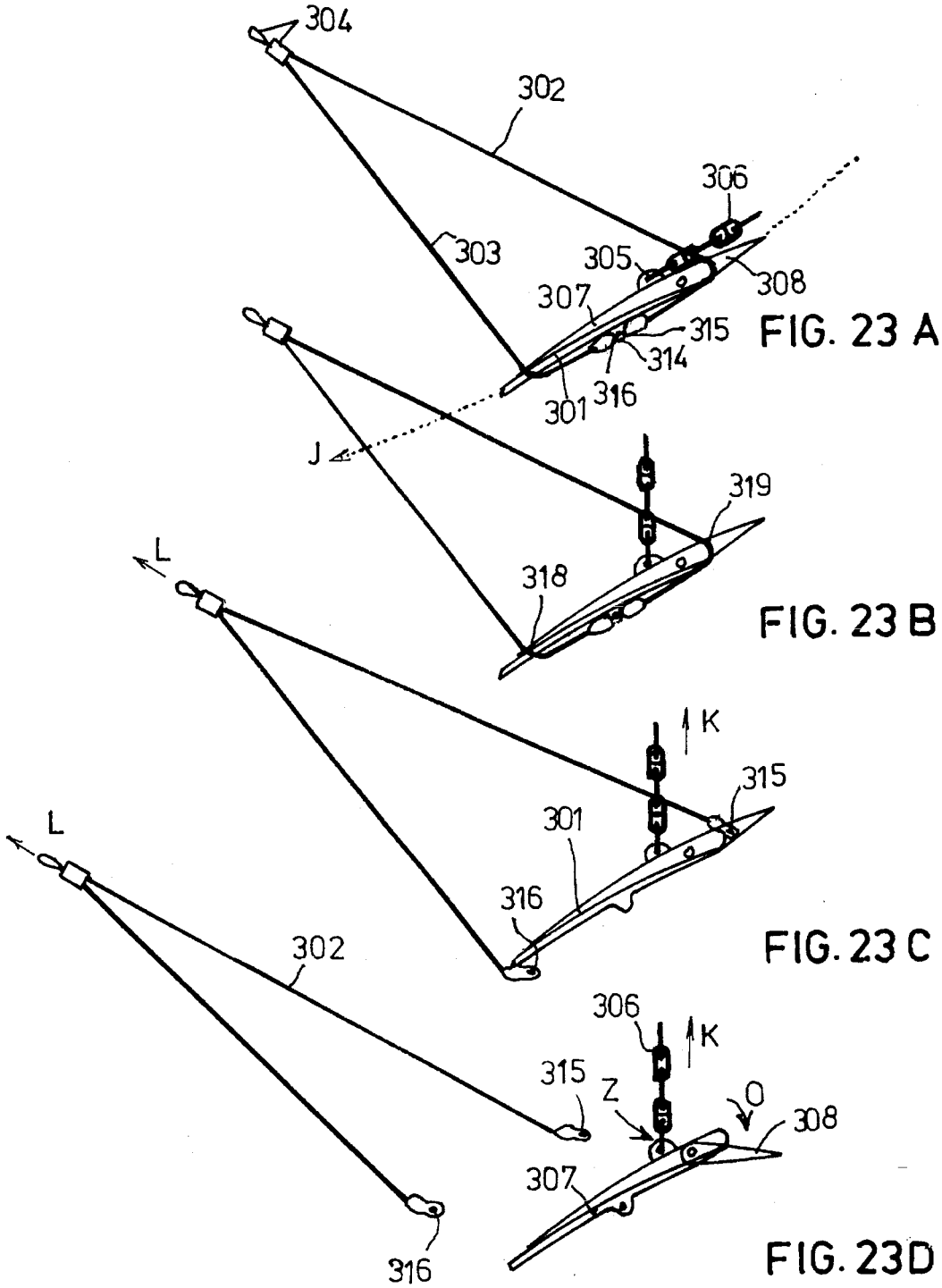
Figure 24A:
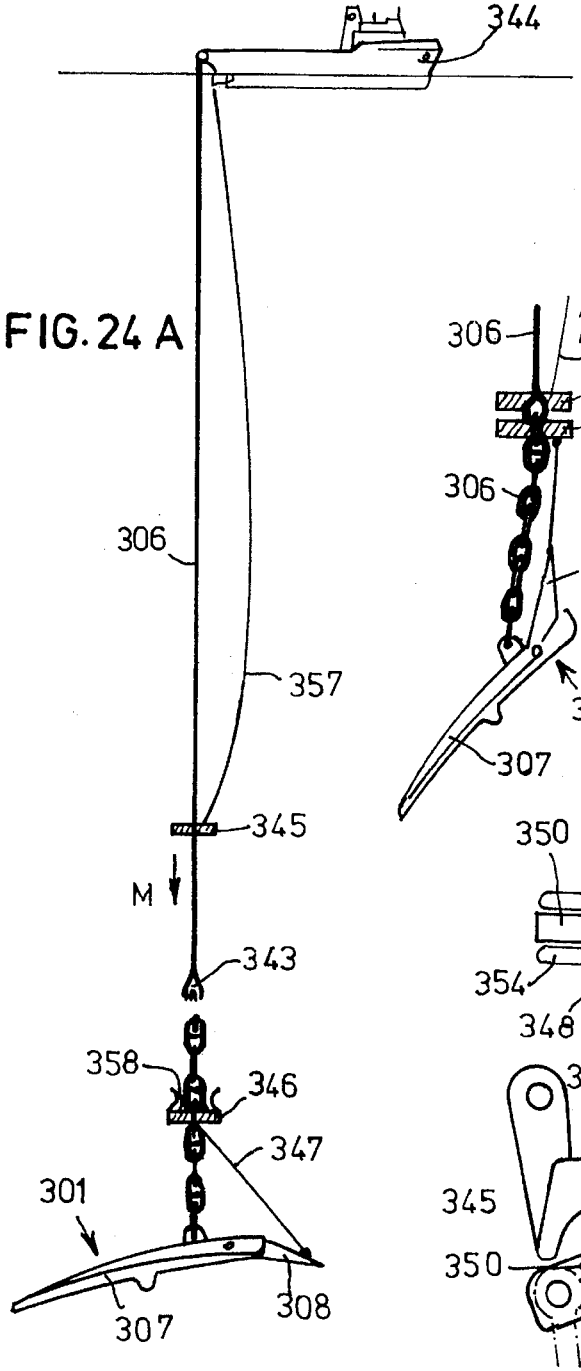
Figure 24B:
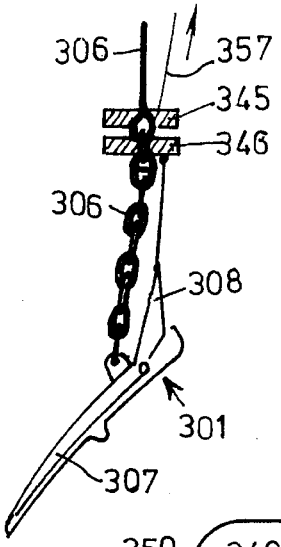
Figure 25A:
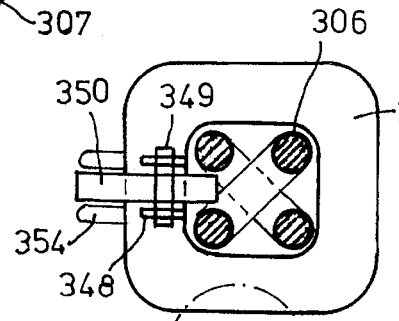
Figure 25B:
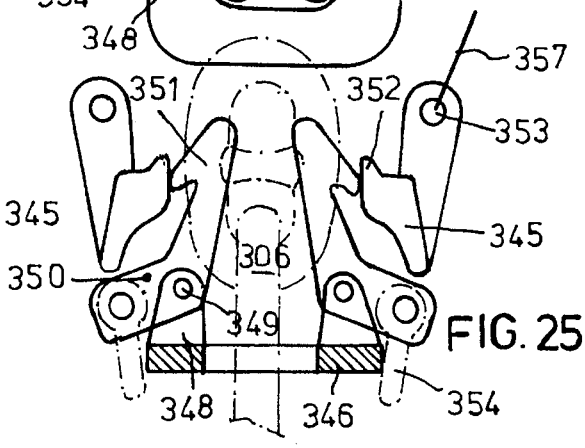

FIGS. 14–16 represent the anchor of FIGS. 12 and 13 during its placement for anchoring purposes; and FIGS. 17 and 18 represent the anchor of FIGS. 12 and 13 during the first stage of weighing the anchor;

FIG. 19 shows another anchor according to the invention, viewed in centre longitudinal section;

FIG. 20 shows the anchor of FIG. 19 in top view;

FIGS. 21A–B show a schematic representation of the mechanism for disconnecting the shank from the anchor of FIGS. 19 and 20;

FIG. 22 shows a further detail of the mechanism for disconnecting the shank from the anchor of FIGS. 19 and 20;

FIGS. 23A–23D show the anchor of FIGS. 19 and 20 during its penetration into the soil and the release of the shank;

FIGS. 24A–B show the fashion in which the anchor can be weighed from the position as represented in FIG. 23D; and FIGS. 25A–B show a schematic representation in top view and in section of the weighing mechanism as shown in FIGS. 24A–B.

Figure 1:
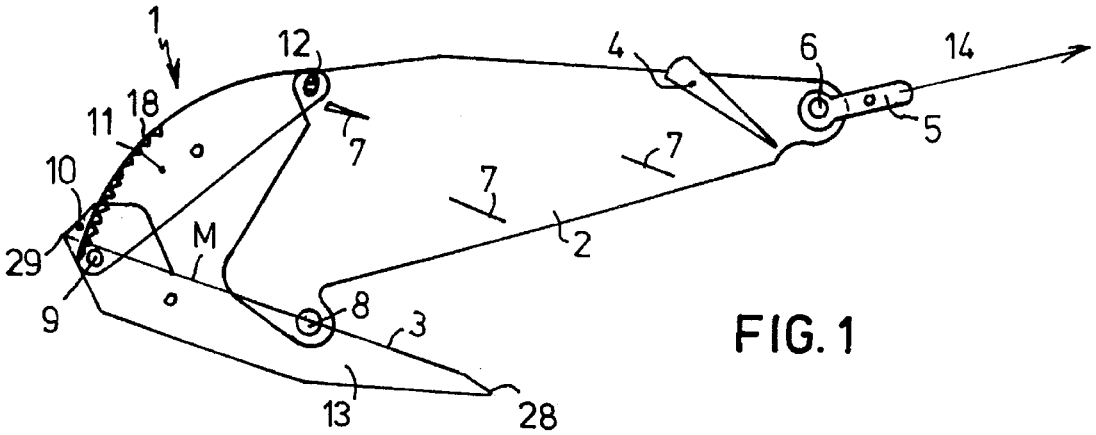
FIG. 1 is a schematic side view of a first embodiment of the anchor according to the invention.

The anchor 1 represented in FIG. 1 comprises a shank 2 and a fluke 3, which is reinforced with girders 13. The surface centre of gravity of the fluke is indicated by M. At the first end there is a shackle 5 mounted on the shank 2 by means of a pin 6, to which shackle the anchor line 14 is attached. The shank 2 furthermore comprises upper flukes 4, which provide extra holding power. The shank 2 is of the type described earlier, i.e. having two forwardly (to the right in the drawing) and upwardly converging shank legs. It is remarked that the anchor according to the invention may also comprise a non-convergent, parallel and/or curved shank. In the drawing one should thus imagine a second shank leg to be present, disposed behind the drawn shank leg. Stiffeners 7 extend between the two shank legs. The fluke 3 has a sharp penetration or front end 28 and a rear end 29, and is also provided with stabilizers 10 on either end at the rear end. The shank 2, or rather each shank leg 2, is connected to the fluke 3 at its girders 13 by means of hinged joint 8. At the rear edge of each shank leg 2 a racket plate 11 is connected by means of a hinged connection 12, said plate comprising a racket 18 extending circularly about the axis of rotation of hinged joint 8. The racket plate 11 is disconnectably connected to the fluke 3 at 9, and such by means of a (not represented) pawl lever, which is attached to a fluke and which can be moved into and out of blocking engagement with the racket 18.

Figure 2:
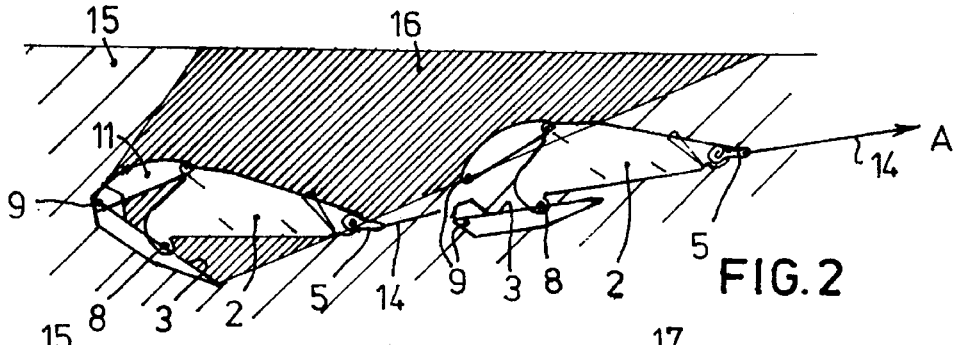
FIG. 2 represents the anchor of FIG. 1, in penetrated condition and whilst being weighed from the drilling platform, respectively, the fluke being disconnected from the shank at the rear.

In FIG. 2 on the left the anchor 1 of FIG. 1 is shown as having penetrated the anchoring soil 15. The anchor line 14 is connected to an object disposed at a considerable distance, e.g. a drilling platform. Reference numeral 16 indicates the soil segment that is able to supply the counterforce required to keep the anchor in its anchoring position. If one wishes to weigh the anchor 1, firstly the (not shown) operating means are activated, so that the pawl is brought out of engagement with the racket 18, thus releasing the connection 9. If the anchor line 14 is then pulled in direction A, the fact that the resultant of the soil pressure on the fluke is located behind the hinged joint 8 ensures that the fluke 3 tilts backwards about hinged joint 8. Upon hauling in the anchor line 14 further, the fluke 3 will be able to turn freely about hinged joint 8 and assume the position of the least resistance. In this way the anchor in question will be easily weighed from the anchored object.

Figure 3:
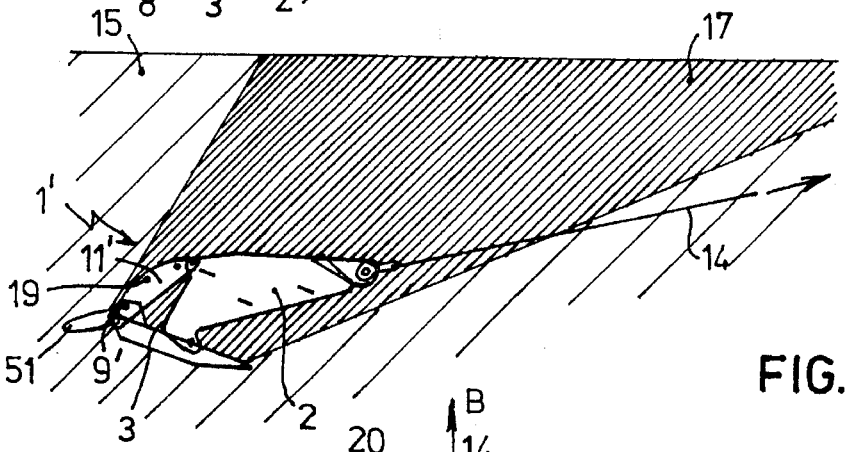
FIG. 3 is a schematic representation of the embodiment of the anchor according to the invention, after maximum penetration, which is ready for the transition to a position for a vertical-anchoring system according to the invention.
Figure 4:
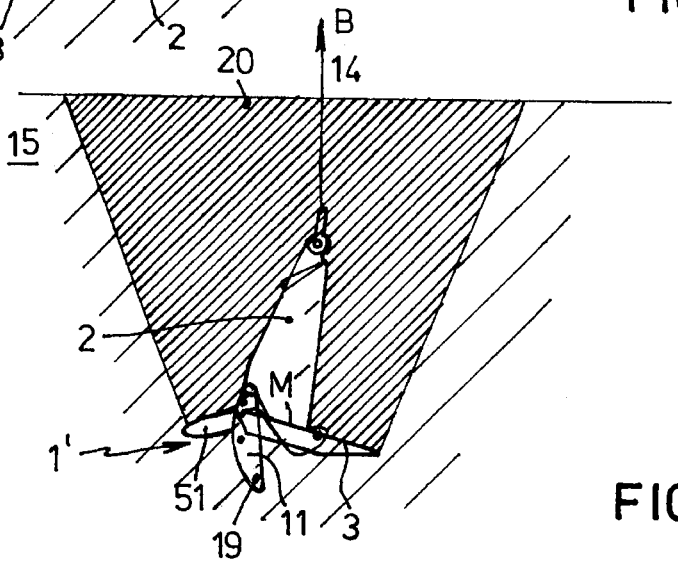
FIG. 4 represents the anchor of FIG. 3 in a situation following the situation of FIG. 3, in which the anchor is incorporated in the vertical-anchoring system.

FIG. 3 shows an anchor 1', being essentially identical to the anchor 1 represented in FIGS. 1 and 2, except for i.a. the disconnectable connection 9'. Here it comprises an arched plate 11', comprising three holes which are spaced at equal distances with respect to the axis of hinged joint 8. The connection 9' furthermore comprises a set of pins movable in and out of engagement with the holes 19 and disposed under the fluke. A number of possible ways in which the pins can be moved back and forth are discussed on the basis of FIGS. 7, 8 and 9. After the anchor 1' is pulled to the position in which maxium penetration is attained, as shown in FIG. 3, and in which the soil segment 17 presses against the fluke 3, the operating means is activated and the pins (not shown) are retracted from the holes 19 in question, so that the disconnectable connection 9' is released. Subsequently the anchor line 14 is transferred to an essentially vertical position above the fluke 3, and as a result of the disconnected connection 9' the shank 2 can turn along about the hinged joint 8, and in this case suitably formed passages in the fluke 3 allow the plate 11 to turn also. Thus the position of the anchor 1' as represented in FIG. 4 is attained, the anchor being tensioned in direction B and pressing against the soil segment 20 with the fluke 3 and the auxiliary fluke 51. Here the fluke angle between fluke 3 and shank 2 is preferably fixed again by re-establishing the disconnectable connection 9', the pin again engaging a hole 19 located at a suitable spot in plate 11.

Figure 5:
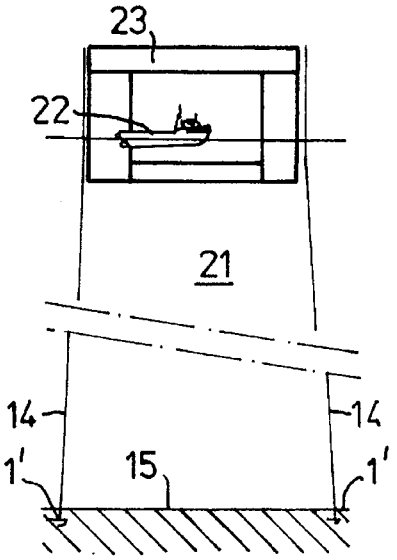
FIG. 5 shows a schematic side view of a vertical-anchoring system according to the invention for a semi-submersible.
Figure 6:
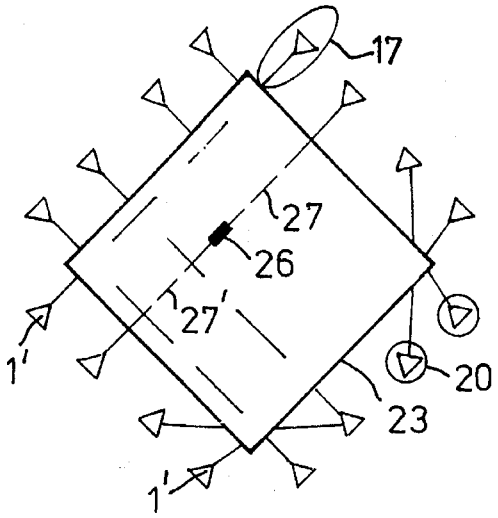
FIG. 6 is a schematic top view of a vertical-anchoring system for a semi-submersible.

In FIG. 5 a vertical-anchoring system according to the invention is shown, in which anchors 1', brought to a position as represented in FIG. 4, are connected with anchor lines 14 to a semi-submersible 23, floating on the body of water 21. FIG. 6 shows what kind of anchor assembly can be used for the anchoring system of FIG. 5. The anchors 1' are first pulled into the ground with the aid of a Stevtensioner, i.a. described in European patent 81258. In this embodiment oppositely paid-out anchors 1' are ingeneously pulled towards one another by pulling anchor line 27', which is passed through a tensioner 26 comprising a one-way blocking means and being disposed near the bottom of the sea, to near to the water level, thus shortening the portion of the anchor line 27' extending between the anchor in question and the tensioner 26, consequently reducing the distance between the two anchors. After the anchors have thus penetrated the soil sufficiently deep and the flukes in the latter direction of pulling exert forces on soil segments having the shape of soil segment 17 in FIG. 3, the disconnectable connections of the anchors are disconnected and the anchor lines 14 are turned around to a vertical direction until the situation represented in FIG. 4 is obtained, having soil segments 20 which are trapezoidal in section and which act on the flukes.

Figure 7A:
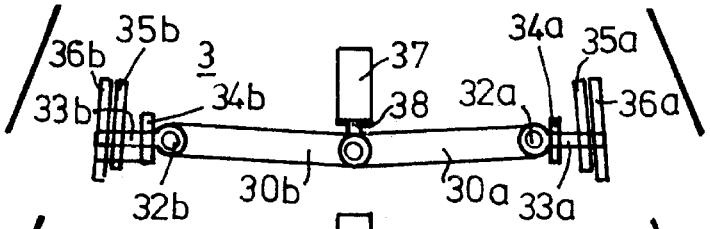
FIGS. 7A, 7B, 8A, 8B, 9A, 9B show various possible embodiments of a disconnectable connection between fluke and shank.
Figure 7B:
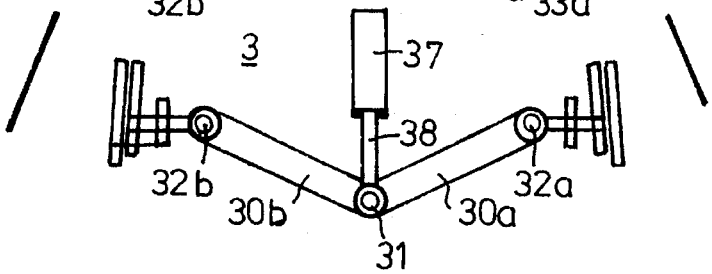

FIGS. 7A and 7B show first embodiments of an operating means and a disconnectable connection according to the invention. A hydraulic piston secured to the underside of fluke 3 which can e.g. be operated acoustically, comprises a piston rod 38, at its end 31 being hinged on two arms 30*a* and 30*b* extending on either side, the said arms in their turn being hinged on pins 33*a* and 33*b* at their other ends at the location of hinges 32*a* and 32*b*. These pins are supported by and guided into eye plates 34*a*, 34*b* also secured on the fluke, in such a fashion that the pins only move in their longitudinal direction. The pins 33*a* and 33*b* protrude through plates 35*a* and 35*b*, also secured to the fluke and comprising a pin passage, which plates may also be part of the reinforcements 13 of the fluke 3. Also represented are the plates 36*a* and 36*b*, comprising holes destined for pins 33*a* and 33*b*, which plates are integrally formed with the shank means of the anchor in question. When the hydraulic piston 37 is activated in any way whatsoever from a place located at a distance from the anchor, the piston rod 38 can be pushed outwards, thus displacing hinge 31, and as a result of the pins 33*a* and 33*b* being guided through the plates 34*a*, 34*b*, 35*a* and 35*b* secured to the fluke, the hinges 32*a* and 32*b* can move towards one another while retracting the pins 33*a* and 33*b* from the plates 36*a*, 36*b*. Then the disconnectable connection between shank and fluke has been released.

Figure 8A:
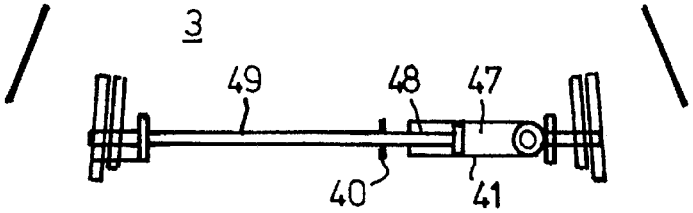
Figure 8B:
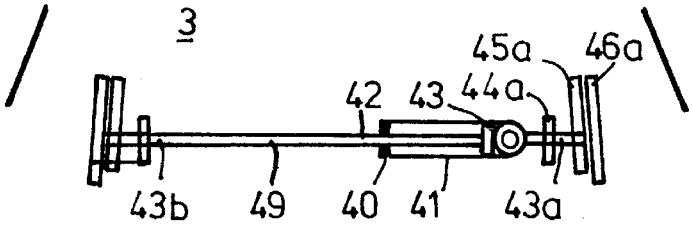

FIGS. 8A and 8B show a second embodiment of the operating means according to the invention, having a disconnectable connection which can even be compared to the one represented in FIGS. 7A and 7B, therefore comprising reciprocably disposed pins 43*a* and 43*b*, which are guided into plates 44*a*, 45*a*, 44*b*, 45*b* secured to the fluke, and protrude into plates 46*b* in the coupled state. A hydraulic piston 41 is now disposed transversely but is also transversely movable. The piston rod 42 is guided through a plate 40 secured to the fluke. The piston 43 connected to the piston rod divides the cylinder into right chamber 47 and left chamber 48. The piston rod 42 is connected to the pin 43*b* via the arm 49. When fluid is now suplied to the chamber 48 by activation of the operating means, on account of the displacement of the hydraulic cylinder and the piston 43 the chamber will be enlarged until the disconnected state as shown in FIG. 8B has been attained.

Figure 9A:
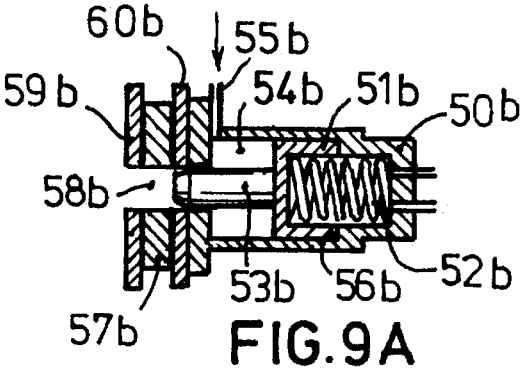
Figure 9B:
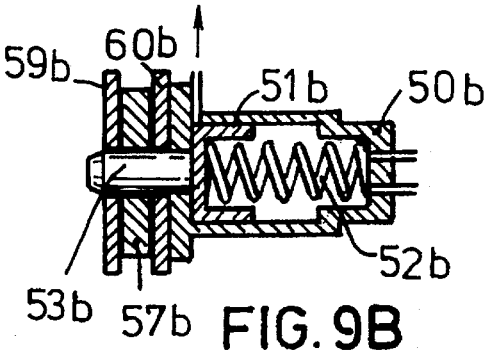

FIGS. 9A and 9B show another possible embodiment of the operating means of the anchor according to the invention. Represented is a hydraulically operable pin 53*b*, being movable into and out of a hole 58*b* of a plate 57*b* connected to a shank leg. The plate 57*b* is slidably disposed between the plates 59*b* and 60*b* secured to the fluke, said plates also comprising holes for receiving the pin 53*b*. The pin 53*b* is connected to a piston 51*b*, which can be forced to the right (at the left as seen in the drawing) by fluid supplied through a conduit 55*b* to chamber 54*b* and on the other side is forced to the left by a spring 52*b*, bearing on the end wall of cylinder 50*b*. When the operating means is activated, pressurized fluid is supplied from a reservoir, not shown, to the chamber 54*b*, causing the piston 51*b* to move to the right until it abuts against a stop surface 56*b* in cylinder 50*b*, in which position of the piston the pin 53*b* has been retracted from the hole 58*b*, so that the plate 57*b* is able to move with respect to the plates 60*b* and 59*b* connected to the fluke. When subsequently the fluke angle is altered through manipulation of the anchor line, the pressurizing of chamber 54*b* by means of fluid can be ceased, so that the spring 52*b* will force the pin to the left. This is advantageous when the aim is to re-establish the disconnectable connection by having the pin protrude into a possibly present next hole in the plate 57*b* connected to the shank. In this way the connection is automatically established and maintained. The movement of the pin into and out of the hole 58*b* can furthermore be facilitated when at least in the vicinity of the hole the pin has a shape that tapers in a direction extending from the piston.

Figure 10:
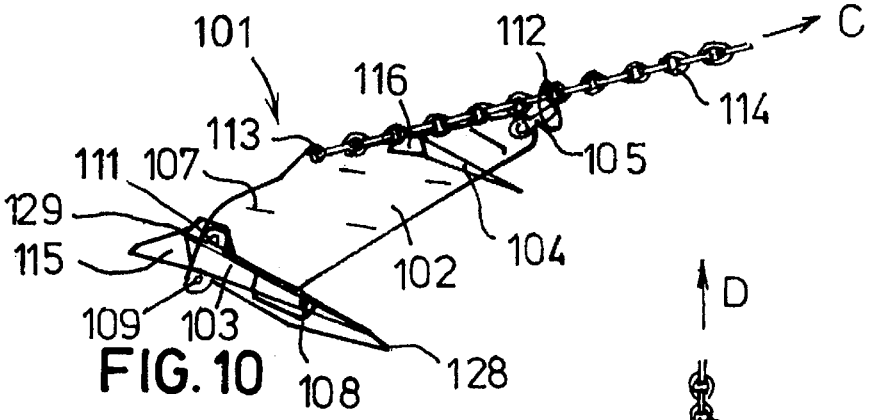
FIGS. 10 and 11 show a third embodiment of the anchor according to the invention, being particularly suited for a vertical-anchoring system.
Figure 11:
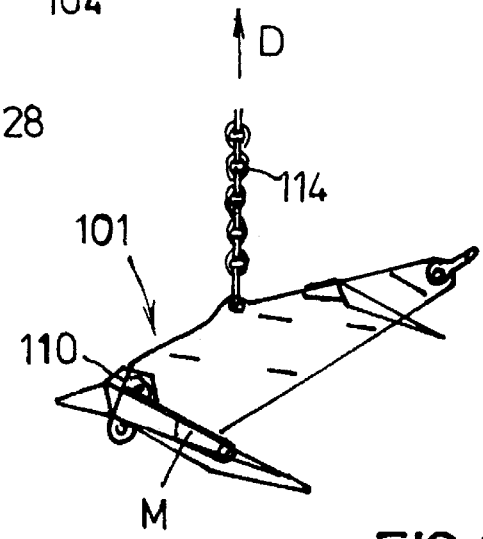

FIGS. 10 and 11 show an anchor according to the invention, which is also suited to be used in vertical-anchoring systems. The anchor 101 comprises a shank 102, a fluke 103 and an upper fluke 104, located on top of the shank, said two flukes at their rear ends each being provided with auxiliary flukes 115, 116, respectively, which extend obliquely downwards and rearwards with respect to the flukes 103 and 104. The auxiliary flukes 115 and 116 are hinged on the flukes 103 and 104 and restricted in their possible extent of inflection by abutments (not shown) on the underside of the flukes 103 and 104. The anchor 101 furthermore comprises at its rear side 129 stabilizers 110 and at its front side 128 a penetration end. At 108 the shank 102 is hinged on the fluke 103, and at 109, connected to the fluke in a disconnectable fashion, e.g. through a pin/hole connection discussed in the foregoing, also established with the aid of a hole plate 111 integrally formed with the shank 102.

A special feature is that the anchor line 114 about halfway down the shank 102 at 113 is rotatably connected to the shank 102, but is connected to the upper end 105 of the shank 102 with the aid of a break connection or break line 112. When a pulling force is exerted in the direction C, it will be just as if the anchor 101 is pulled in the normal, usual manner for pulling anchors into the ground. When the anchor has penetrated the soil sufficiently deeply, one merely has to swing out the anchor line 114 to a vertical orientation in order to use the anchor 101 in a vertical-anchoring system, upon which the break line 112 will break and the anchor line 114 is only connected to the anchor at the location of reference numeral 113. In this way the fluke angle can remain unaltered and an anchor for a vertical-anchoring system has been placed in a simple manner. Alternatively, two lines can be used, the one anchor line being then connected to the upper end 105 of the anchor 101 and being used during penetration of the anchor, whereas another anchor line is connected to the shank 102 at 113, and is merely used when a pulling force in direction D has to be exerted in the vertical-anchoring system.

It is remarked that although the above description refers to a semi-submersible when dealing with FIGS. 5 and 6, the invention is equally applicable to tension-leg platforms.

The anchor 201 represented in FIGS. 12 and 13 comprises a fluke 202, with a longitudinal plane of symmetry I—I, which fluke is essentially composed of a conical upper plate 203 and an also conical lower plate 204, being attached to the upper plate 203 along its edge. The space between the upper plate 203 and the lower plate 204 is essentially hollow. The fluke 202 is furthermore reinforced by two longitudinal girders 205 and 206 and a cross bracing 228, 229. At the front end or penetration end the longitudinal girders 205 and 206 merge into penetration tips 207 and 208, which have been flanged just a little bit more with respect to the plane of the upper plate 203 of the fluke 202. This feature advances the initial stage of penetration into the anchoring soil. At its rear end the fluke 202 comprises an auxiliary fluke 209, attached by means of hinges 210 and 211 onto the fluke. At its top and centre of gravity T, the double-conical fluke 203 is connected via a releasable coupling, operable by means of remote control, to the lower end of a chain F. The coupling may be operated acoustically, vide e.g. Dutch patent application 86 00126, but also mechanically, hydraulically or pneumatically, through a conduit 226 suited for that purpose, as the chain F offers the option to exclude the necessity of an extra, loose line by guiding it along the chain F.

At the top of the fluke 203 at the rear of the centre of gravity T, furthermore two attachment means 216 and 217 are provided, by which cables 212 and 213, respectively, are connected to the fluke 202. At 224 the other end of these cables 212 and 213 is connected to coupling plate 220, to which at 221 a penetration anchor line E is connected. The coupling plate 220 is also provided with an attachment means 225 for cables 214 and 215, which are attached at the location of attachment means 215 and 219, respectively, at the front of the fluke 202. Thus a construction built of tension cables 212–215 is obtained, comparable to a shank but much lighter than the usual shanks built of plates and transverse reinforcements. The coupling plate 220 is so formed as to be disposed in two possible positions between the cables 212–215 and the anchor line E. The first position, represented by the uninterrupted lines in FIG. 12, is desireable when the anchor of FIG. 12 is to be used in muddy soil. In that case the angle between the fluke, in this case the frontmost part of the upper surface 203 of the fluke 202, and the direction of pulling in the anchor line E should be approx. 48°. In sandy soils, this angle amounts to approx. 30°, for which purpose the coupling plate 220 can be mounted reversedly up to the position represented by 220' in interrupted lines in FIG. 12. In this embodiment, the cables 212, then 212', are connected to attachment means 225' and the cables 214, then 214', are connected to attachment means 224'.

Apart from that an extra cable G can be seen in FIGS. 12 and 13, extending between a connection 222, where this cable G is connected to the lower end of chain F, and an attachment eye 231 on the coupling plate 220. The function of this cable G will be further elucidated hereinafter.

When the anchor 201 of FIGS. 12 and 13 has to be cast, one should take care that the anchor ends up on the anchoring soil 230 in the position shown in FIG. 14. The chain F will then have some surplus length, making it slack. If, e.g. aboard an auxiliary vessel, the chain E is pulled (vide the arrow), then the flux 202 with its tips 207 and 208 will engage the soil and embed itself deeper and deeper. During penetration only portion F' of the upper surface 203 as hatched in FIG. 13 will meet resistance from the soil in the bottom 230. The portion G' disposed behind that (vide FIG. 13) will not or hardly meet any resistance. Here the chain F follows the downwards movement of the anchor 201. FIG. 15 represents the anchor during penetration. When the anchor has penetrated sufficiently deep, the position of FIG. 16 has been obtained. The anchor line E is then paid out and connected to a buoy that is set out so as to be able to easily pick up the anchor line later on. Alternatively, the anchor line E may be connected to the anchor through a breaking wire adjusted to the desired holding power. Then the moment has come to connect the cable or chain F to the object to be anchored, this being e.g. a semi-submersible or TLP. Aboard this object tensioning means are provided for pulling the chain F taut. The point of engagement of chain F is disposed in or near the centre of gravity of the fluke and also at the top of the double-conical fluke. When exerting the vertical pulling force on the fluke the portion G' (FIG. 13) will also be active in offering resistance against displacement of the fluke. Additional resistance is provided by the auxiliary fluke 209, which was initially pulled freely along into the soil but is now twisted by soil pressure until it is stopped by the stop surfaces suited therefor on the fluke 202. This restricts the rearward motion of the fluke 202. Therefore the anchor according to the invention is an anchor quite capable of penetrating mud or sand and extremely suited for vertical-anchoring systems.

Drilling platforms and TLPs are more and more displaced to a next location during their lives. It may be advantageous if parts of the anchoring system can be used again. The manner in which such can be done with an anchor according to the invention is represented in FIGS. 17 and 18. From the TLP or the drilling platform a conduit 226 extends along the chain F, which conduit can be used to operate the coupling 223 between the lower end of the chain F and the fluke 202, so as to release it. The conduit 226 may be a simple pulling cable, by means of which the connection 223 can be pulled apart into part 223" on the fluke 202 and part 223' at the lower end of the chain F. The connection between the lower end of the chain F and cable G will remain unchanged. When subsequently the chain F is pulled, this pulling force will be transferred via cable G to the coupling plate 220 and thus to the cables 212–215 and finally to the fluke 202. Then the situation of FIG. 18 is attained, in which the anchor 201 is pulled from the bottom and weighed onto the TLP or onto the drilling platform itself. In this respect it is particularly advantageous that with simple means the anchor can be weighed from the anchored object itself. It goes without saying that cable G can also replace the two cables 212 and 213 (FIG. 13) during the penetration situation and be arranged at the correct length for the desired angle of penetration.

The anchor 300 as represented in FIGS. 19 and 20 comprises a fluke 301 and a shank 302, 303. The fluke 301 comprises a frontmost fluke part 307 and a rearmost fluke part 308, being hinged on one another at 309 about an axis and perpendicularly to the plane of drawing. The upper surface 311 of the fluke is curved. In the surface centre of gravity Z of the upper surface 311 the fluke 301 comprises an attachment plate 305, to which the vertical-anchoring chain 306 is attached by means of a closing link 310. The shank comprises two rearmost wires 302 (disposed on either side of the plane of symmetry) and two frontmost wires 303 (disposed on either side of the plane of symmetry), being joined at the top end and comprising an attachment eye 304 for connection to a penetration anchor line. At their other end the shank wires 302 and 303 are passed through slits 318 and 319 (vide FIG. 20) towards the underside of the fluke, where they are attached to the attachment member 312 protruding downward from the underside of the fluke. For this purpose the shank wires 302 and 303 are fitted at their outer ends with cable eyes 315 and 316, through which a pin 314 protrudes which is to be further discussed hereinafter, which pin cooperates with the attachment member 312 to keep the cable eyes 315 and 316 in their proper positions with respect to the fluke. Another pin 313 can be seen at the front of the means 312.

In FIG. 20 the fluke 301 is shown in top view, but some parts which are disposed at the underside of the fluke have also been shown for illustrative reasons. Furthermore some height lines of the upper surface 311 of the fluke are shown so as to underline the curved nature of the fluke 301. Apart from that the plane of symmetry S—S is shown, extending perpendicularly to the plane of the drawing. At the underside of the upper surface 311 girders 317 are mounted on either side of the plane of symmetry. With their undersides these girders 317 constitute a reversed U-shaped gutter for laterally enclosing and for guiding the portions of the shank wires 302 and 303 which extend underneath the fluke 301. At the position where the upper plate 355 (vide FIG. 21A) of this guiding ends, there is the passage slit 318 at the front and the passage slit 319 at the rear. These are suited to allow the cable eyes 315 and 316 to pass. The rear edge of the slits 319 is defined by a front edge of the hingeable rear part 308 of the fluke 301.

It is remarked that, as can be seen in FIG. 20, there are two pins 313, 314 on each side of the fluke, one disposed behind the other. Now it is possible to secure the cable eyes 315, 316 with the aid of the pin 314, in which case-the shank will assume the position as represented in FIG. 19 by means of wires 302' and 303'. The fluke angle amounts to approx. 32° in this case. Alternatively, it is possible to attach the cable eyes 315, 316 to the fluke with the aid of the pin 313. Then the position of the shank with respect to the fluke as represented by the wires 302, 303 in FIG. 19 is attained, the fluke angle being approx. 50°. As a further alternative the cable eye 315 can be attached to the fluke by means of pin 314 and the cable eye 316 can also be attached to the fluke by means of pin 313. The fluke angle will then have an intermediate value, in this case 41°.

FIG. 20 furthermore schematically shows some parts of the disconnecting mechanism for the shank wires 302 and 303. These parts are disposed on the other side of the upper surface 311. The pins 313 and 314 can be seen, which are connected to ends of the operating rods 321, 320, respectively, which are attached in a fashion to be discussed hereinafter to a further operating rod 339, respectively, the latter rod being furthermore connected through a further operating part 326 to an operating line 337, which is attached to the vertical-anchoring line 306.

The disconnecting mechanism is furthermore elucidated on the basis of FIGS. 21A, 21B and 22. In FIGS. 21A and 21B the disconnecting mechanism and the way it is operated are represented in a section perpendicular to the plane of symmetry S. One can see the upper surface 311 of the fluke, conical in section, as well as the undersurface of the fluke 328, at least partly similar in section.

The attachment plate 305 for the vertical-anchoring line extends through the fluke. The closing link 310 of the vertical-anchoring line is attached to the plate 305. On either side of the plane of symmetry S the same type of disconnecting mechanism is provided. On should bear in mind that on either side of the plane of symmetry S there are shank wires 302, 303. In the downwardly protruding part 312 of the longitudinal girders 317, in their side plates 329, 330 to be precise, holes 332, 331, respectively, are provided, into which the pin 314 can be slid. In its coupling position, depicted in FIG. 21A, the pin 314 protrudes through the hole 332, through the cable eye 315, through the cable eye 316 as well as through the hole 331. In this fashion the shank wires 302, 303 are securely attached to the underside of the fluke. The pin 314 is firmly secured to the end of an angular rod 333, which can also be slid back and forth in a direction perpendicular to the plane of symmetry S, during which it is guided by suitable guiding means 334. At its other end the arm 333 is hinged at 327 on a lever member 336, being firmly secured at its other end to a rod 339 extending perpendicularly to the plane in the drawing. This rod (vide also FIGS. 20 and 22) is pivotably borne on the fluke at 341 and 342. Bearing 341 is positioned in the transverse beam 323. As can be deduced from FIGS. 20 and 22, the rod 339 comprises at its rear end a further, fixed lever member 326, at whose radial outer end 238 the connecting wire 337 is connected at 238. At its other end, the connecting wire 337 is connected to the vertical-anchoring line 306.

In FIG. 22 it can be observed that the two pins 313 and 314 are both connected to the rod 339 in a similar fashion. Now if by exerting a pulling force on the vertical-anchoring line 306 so as to pull it more tautly a pulling force is also exerted on the connecting line 337, the levers 326 will be twisted upwards (vide FIGS. 21A–B), as a result of which the rods 339 will also be twisted in the directions $Q_1$ and $Q_2$. This will cause the lever members 336 to be twisted downwards en inwards, so that the arms 333 are guidingly shifted inwards. Then the situation of FIG. 21B is finally achieved, in which the pins 314 have been moved out of the cable eyes 315 and 316.

In FIGS. 23A–D schematically show the fashion in which the anchor of FIGS. 19 and 20 can be installed. In FIG. 23A, by means of a penetration anchor line (not shown) which is attached to the outer end 304 of the shank 302, 303, the fluke 301 is pulled in the direction of arrow J. The vertical-anchoring line 306, being attached to the fluke by means of plate 305, is dragged along through the soil. At the underside of the fluke the end blocks of the shank wires 302 and 303 can be seen, which comprise cable eyes 315, 316 in which the pin 314 engages. In FIG. 23B it has been established, on the basis of the tension measured in the penetration anchor line, that the anchor, or to be more precise the fluke, has penetrated sufficiently and appears to be able to supply the desired (vertical) holding power. Then the vertical anchor line 306, which was initially slack, is pulled taut with the aid of a winch aboard a vessel (not shown) in the vertical direction K. By pulling this line taut, the disconnecting mechanism at the underside of the fluke is activated, causing the pin 314 to slide out of the cable eyes so that the eyes 315 and 316 of the shank wires 302 and 303 are detached from the fluke. Then the penetration anchor line is pulled in direction L (vide FIG. 23C) and the ends 315, 316 will first move away from one another in the guidings along the underside of the fluke, subsequently to move through the slits 318, 319 towards the other side of the fluke, after which the shank has been completely released from the fluke and the penetration anchor line 306 and the shank can be weighed completely. Subsequently the vertical-anchoring line is tensioned in direction K, resulting in an upward force being exerted on the fluke in its centre of gravity Z. The fluke 301 will then move slightly upwards and due to the pressure exerted by the superposed soil onto the fluke the rear part 308, which has a smaller surface than the remaining part of the fluke, will twist in the direction O untill it is stopped by abutment 358 (FIG. 19).

FIGS. 24A, 24B and figures show in what special manner the fluke 301, after having been operative in the position shown in FIG. 23D, can be removed from the soil. For this purpose the rear end of the rear part 308 of the fluke is connected by means of one or more wires 347 to a ring 346, slidable along the vertical-anchoring line 306 and initially kept in its position by means of breaking line 358, attached to one of the chain links. For clarity's sake the ring 346 is represented at a distance above the fluke. The line 306 comprises in its lower portion a chain, merging into a cable at its upper end 343, which in its turn is attached with its upper end to an auxiliary vessel 344. From the auxiliary vessel or platform 344 a line 357 is paid out, to the other end of which a catcher (ring) 345 is attached. This catcher 345 moves down the line 306 in direction M, until it arrives at the ring 346. As can be seen in FIGS. 25A and 25B, the ring 345 not only comprises attachment plates 353 for the line 357, but also an annular protrusion 352 (vide the vertical section of FIG. 25B). The ring 346 connected through line 347 to the rear fluke 308, shown in upper view in FIG. 25A, comprises at its upper end some attachment plates 348, onto which by means of pins 349 levers 350 are hinged. The levers 350 comprise hooks 351 at their top end. When the ring 345 has moved downwards sufficiently, the annular teeth 352 will engage the hooks 351 and an upwards force, exerted on the line 357, will cause the breaking line 358 to break and the ring 346 to be tagged along upwards and thus the line 347 will be pulled taut, so that the hingeable rear part 308 of the fluke will be pulled upwards.

I claim:

1. Anchor fluke, being so formed as to have a penetration or front-side and a rear side, as well as a longitudinal plane of symmetry intersecting these sides, said anchor fluke comprising first means for attachment of an anchor line for a vertical anchoring system and second means for attachment of at least two connecting means spaced in the longitudinal plane of symmetry so as to connect the fluke to a pulling or penetration anchor line, the fluke being so formed that at least its upper surface has a shape convexly curved or buckled in cross-section along the plane of symmetry, the first attachment means for the anchor line for a vertical anchoring system being located near the centre of area of the fluke.

2. Anchor fluke according to claim 1, in which the lower surface of the fluke is essentially equal in shape to the upper surface of the fluke.

3. Anchor fluke according to claim 1, in which the top surface of the fluke has a correspondingly curved or buckled appearance in a cross-section in a plane comprising the centre of area and being perpendicular to the said plane of symmetry of the fluke.

4. Anchor fluke according to claim 3, in which the upper surface is essentially conical.

5. Anchor fluke according to claim 3, in which the lower surface of the fluke is essentially conical.

6. Anchor fluke according to claim 1, comprising connecting means between the fluke and the penetration anchor line, which are formed as cable-shaped or chain-shaped connecting lines.

7. Anchor with anchor fluke according to claim 6, in which the second attachment means for the connecting means to the penetration anchor line are disposed on the fluke at two locations spaced in the longitudinal direction viewed in projection on the plane of symmetry and in which the second attachment means at a rearmost of these two locations can be operated by means of remote control so as to release the connecting means at the rearmost location.

8. Anchor with anchor fluke according to claim 6, in which the first attachment means for the vertical-anchoring line also indirectly constitute the attachment means for a single, central, rearmost connecting line, said connecting line then being connected to the lower end of the vertical-anchoring line and the latter itself being attached to the fluke for releasing it by means of remote control.

9. Anchor with anchor fluke according to claim 6, in which the first attachment means for the vertical-anchoring line on the fluke are operable by means of remote control in order to release them, and in which a coupling line is disposed between the lower end of the vertical-anchoring line and the upper end of the connecting lines to the lower end of the penetration anchor line.

10. Anchor with anchor fluke according to claim 6, in which the frontmost and rearmost connecting lines are connected to the penetration line by means of coupling means, which enable the adjustment of the angle between the connecting lines and the fluke.

11. Anchor according to claim 10, in which said coupling means consist of a coupling plate, comprising an attachment means for the penetration line and attachment means for the frontmost and rearmost connecting lines, said attachment means thereon being spaced at another distance with respect to the attachment means thereon for the penetration line than the attachment means thereon for the frontmost connecting lines.

12. Anchor fluke according to claim 1, in which a part of the fluke, bordering on the rear and being disposed to the rear of the centre of area, is hinged on the remaining part of the fluke by means of a hinge of which the hinge axis is perpendicular to the plane of symmetry, in such a fashion that the upper surface of the hingeable rear part is able to assume an angle of over 180° with respect to the upper surface of the adjoining remaining part of the fluke.

13. An anchor fluke according to claim 12 further comprising means for limiting the extent of travel of the hinged fluke part with respect to the remaining part of the fluke.

14. Anchor fluke according to claim 1, in which the lower surface of the fluke has a curved or buckled appearance in a cross-section in a plane comprising the centre of area and being perpendicular to the said plane of symmetry of the fluke.

15. Anchor fluke, being so formed as to have a penetration or front-side and a rear side, as well as a longitudinal plane of symmetry intersecting these sides, said anchor fluke comprising means for attachment of at least two connecting means spaced in the longitudinal plane of symmetry so as to connect the fluke to a pulling or penetration anchor line, the fluke being so formed that at least its upper surface has a shape convexly curved or buckled in cross-section along the plane of symmetry, and also has a correspondingly curved or buckled appearance in a cross-section in a plane comprising the center of area and being perpendicular to said plane of symmetry of the fluke.

16. Anchor fluke according to claim 15, in which the lower surface of the fluke is essentially equal in shape to the upper surface of the fluke.

17. Anchor fluke according to claim 15, in which the upper surface is essentially conical.

18. Anchor fluke according to claim 15, in which the lower surface is essentially conical.

19. Anchor fluke according to claim 15, wherein each of said connecting means between the fluke and the penetration anchor line is a wire cable.

20. Anchor with anchor fluke according to claim 19, in which the attachment means for the connecting means to the penetration anchor line are disposed on the fluke at two locations spaced in the longitudinal direction viewed in projection on the plane of symmetry, and in which the attachment means at a rearmost of these two locations can be operated by means of remote control so as to release the connecting means at the rearmost location.

21. Anchor fluke according to claim 15, wherein each of said connecting means between the fluke and the penetration anchor line is a chain.

22. Anchor fluke according to claim 15, in which a part of the fluke, bordering on the rear and being disposed to the rear of the center of area, is hinged on the remaining part of the fluke by means of a hinge of which the hinge axis is perpendicular to the plane of symmetry, in such a fashion that the upper surface of the hingeable rear part is able to assume an angle of over 180° with respect to the upper surface of the adjoining remaining part of the fluke.

* * * * *

UNITED STATES PATENT AND TRADEMARK OFFICE

CERTIFICATE OF CORRECTION

PATENT NO. : 5,546,884
DATED : August 20, 1996
INVENTOR(S) : Rob VAN DEN HAAK

It is certified that error appears in the above-indentified patent and that said Letters Patent is hereby corrected as shown below:

ON TITLE PAGE, ITEM 73, "VRIJOF" SHOULD BE -- VRIJHOF-- AND

ITEM 62, AFTER "1994" ADD -- WHICH IS the national stage of

International Application PCT/NL92/00144, filed August 17,1992.--

AT COLUMN 1 , LINE 5, delete "pending" and insert -- the national stage of International Application PCT/NL92/00144, filed August 17, 1992--

Signed and Sealed this

Fourteenth Day of April, 1998

Bruce Lehman

*Attest:*

BRUCE LEHMAN

*Attesting Officer*

*Commissioner of Patents and Trademarks*